US007731633B1

(12) United States Patent
Williams

(10) Patent No.: US 7,731,633 B1
(45) Date of Patent: Jun. 8, 2010

(54) EXERCISE GLOVE FOR INTRINSIC MUSCLES AND METHOD OF USE

(76) Inventor: Randall K. Williams, 508 Ball St., New Smyrna Beach, FL (US) 32168

( * ) Notice: Subject to any disclaimer, the term of this patent is extended or adjusted under 35 U.S.C. 154(b) by 652 days.

(21) Appl. No.: 11/490,450

(22) Filed: Jul. 21, 2006

(51) Int. Cl.
*A63B 23/16* (2006.01)

(52) U.S. Cl. ..... 482/47; 482/44; 482/48; 482/148

(58) Field of Classification Search ..... 482/47, 482/148
See application file for complete search history.

(56) References Cited

U.S. PATENT DOCUMENTS 3,347,547 A * 10/1967 Hynes ..... 482/47
3,421,761 A * 1/1969 Grant ..... 473/61
3,944,220 A 3/1976 Fasano
4,706,658 A * 11/1987 Cronin ..... 602/13
4,765,608 A 8/1988 Bonasera
4,781,178 A * 11/1988 Gordon ..... 602/22
4,830,360 A * 5/1989 Carr, Jr. ..... 482/47
5,113,526 A * 5/1992 Wang et al. ..... 2/2.5
5,222,925 A * 6/1993 Maycock et al. ..... 482/44
5,230,699 A * 7/1993 Grasinger ..... 602/22
5,261,393 A * 11/1993 Weinzweig ..... 601/40
5,362,295 A * 11/1994 Nurge ..... 482/124
5,373,585 A 12/1994 Wiggins
5,413,554 A * 5/1995 Trueman ..... 602/21
5,445,582 A * 8/1995 Brown ..... 482/48
5,447,490 A 9/1995 Fula et al.
5,453,064 A * 9/1995 Williams, Jr. ..... 482/47
5,456,650 A 10/1995 Williams, Jr. et al.
5,527,244 A 6/1996 Waller et al.
5,538,488 A 7/1996 Villepigue
D374,469 S * 10/1996 Barra ..... D21/684
5,613,923 A * 3/1997 Anliker ..... 482/48
5,628,069 A * 5/1997 Ebert ..... 2/161.1
5,697,103 A * 12/1997 Wiggins ..... 2/159
5,723,785 A * 3/1998 Manning ..... 73/379.03
5,768,710 A * 6/1998 Williams ..... 2/161.1
5,820,577 A * 10/1998 Taylor ..... 601/40
5,823,980 A * 10/1998 Kopfer ..... 602/21
5,876,363 A * 3/1999 Marx ..... 602/21
5,957,813 A * 9/1999 Macdonald ..... 482/44
5,976,058 A 11/1999 Gustafson
5,981,856 A * 11/1999 Story ..... 84/319
5,993,362 A * 11/1999 Ghobadi ..... 482/124
6,010,473 A * 1/2000 Robinson ..... 602/21

(Continued)

*Primary Examiner*—Steve R Crow
*Assistant Examiner*—Robert F Long
(74) *Attorney, Agent, or Firm*—Paul S. Rooy PA

(57) ABSTRACT

An exercise glove for intrinsic muscles and method of use. The exercise glove incorporates rigid ribs having rib distal end angles corresponding to patient metacarpal phalangeal joint angles. The ribs passively hold the patient metacarpal phalangeal joint angles in extension, while the patient actively flexes the proximal interphalangeal joints and distal interphalangeal joints to obtaining optimal intrinsic muscle stretching. The rib distal end angles may be set by a physical therapist to correspond to individual patient metacarpal phalangeal joint angles, or alternately an array of ribs of different rib distal end angles may be provided with the exercise glove, from which rib assortment the physical therapist may choose ribs having appropriate rib distal end angles ribs to attach to the exercise glove. The method includes the steps of using the exercise glove to passively hold metacarpal phalangeal joints in extension, while actively flexing proximal and distal interphalangeal joints.

21 Claims, 7 Drawing Sheets

U.S. PATENT DOCUMENTS 6,093,162 A * 7/2000 Fairleigh et al. ..... 602/22
6,119,267 A * 9/2000 Pozzi ..... 2/20
D436,148 S * 1/2001 Villepigue ..... D21/684
6,179,751 B1 * 1/2001 Clears ..... 482/48
6,228,001 B1 * 5/2001 Johnson et al. ..... 482/48
6,231,488 B1 * 5/2001 Dicker et al. ..... 482/124
6,258,014 B1 * 7/2001 Karecki ..... 482/121
6,287,242 B1 * 9/2001 Fray ..... 482/121
6,371,932 B1 * 4/2002 Foote ..... 602/22
6,450,924 B1 9/2002 Block
6,475,174 B1 * 11/2002 Chow ..... 602/5
6,569,061 B2 * 5/2003 Stearns et al. ..... 482/52
6,692,452 B2 * 2/2004 Chow ..... 602/5
6,817,967 B1 * 11/2004 Ott et al. ..... 482/48
7,001,352 B2 * 2/2006 Farrell et al. ..... 602/21
D518,535 S * 4/2006 Haskell ..... D21/662
7,147,590 B2 * 12/2006 Toven ..... 482/51
7,175,574 B2 * 2/2007 Carmel et al. ..... 482/124
7,210,172 B2 * 5/2007 Adams, Jr. ..... 2/163
7,381,156 B2 * 6/2008 Silagy ..... 482/47
2002/0151832 A1 * 10/2002 Wedge, Jr. ..... 602/22
2003/0162634 A1 * 8/2003 Farrell et al. ..... 482/47
2003/0195093 A1 10/2003 White
2004/0215121 A1 * 10/2004 Parker ..... 602/23
2005/0124464 A1 6/2005 Priore
2005/0227830 A1 * 10/2005 Tomlin ..... 482/105
2006/0247102 A1 * 11/2006 Kupferman ..... 482/44
2007/0129216 A1 * 6/2007 Ott et al. ..... 482/48
2007/0254780 A1 * 11/2007 Findeisen ..... 482/48
2009/0156361 A1 * 6/2009 Ferri ..... 482/1

* cited by examiner

EXERCISE GLOVE FOR INTRINSIC MUSCLES AND METHOD OF USE

BACKGROUND OF THE INVENTION

1. Field of the Invention

This invention relates to therapeutic exercise gloves, and in particular to an exercise glove for intrinsic muscles and method of use.

2. Background of the Invention

Aside from the human brain, the hand is arguably the most important feature that sets humans apart from other living creatures. Hands incorporate opposable thumbs, which allows grasping of different articles. Absent the opposable thumb, mankind's progress would have been greatly hampered.

Hands consist of the wrist, or carpus, the palm (metacarpus) and the digits: four fingers and the afore-mentioned opposable thumb. Twenty seven bones make up the hand skeletal structure. Thirty five muscles move the human hand, allowing a great variety of intricate and delicate tasks to be accomplished. From jeweler to musician to legal secretary, the hand is one of the most important tools.

Thus, it can be extremely disabling and inconvenient when a hand is injured. Hand repair and healing frequently involves rehabilitation of muscles which may have shrunken and become atrophied during the hand healing process. One of the most challenging sets of muscles to rehabilitate can be the intrinsic muscles. Thus, it would be desirable to provide an exercise glove for intrinsic muscles, which permits these to be exercised and rehabilitated in a physical therapy environment following damage or injury to the hand.

Referring now to FIG. 1, we observe human hand 2. Each digit comprises three segments: proximal finger segment 5, middle finger segment 7, and distal finger segment 9, and three associated bones: proximal phalanx 4, middle phalanx 6, and distal phalanx 8. Proximal phalanx 4 is rotatably attached to metacarpus 3 at metacarpal phalangeal joint 10. Middle phalanx 6 is rotatably attached to proximal phalanx 4 at proximal interphalangeal joint 12. Finally, distal phalanx 8 is rotatably attached to middle phalanx 6 at distal interphalangeal joint 14.

Hand 2 muscles further comprise the thenar imminence 16 at the base of the thumb. Thenar imminence base 18 is disposed at the wrist-side end of thenar imminence 16, slightly off-center of the wrist towards the radial side.

The intrinsic muscles are made up of two principal groups: the lumbrical muscles, and the interossei muscles. The lumbricals are disposed on the radial side of each digit. The interossei are divided into two sets: the dorsal interossei and the palmar interossei. The dorsal interossei are disposed between the metacarpal bones. The palmar interossei are smaller than the dorsal interossei, and are disposed along the radial side of each digit.

The palmer interossei muscles adduct the fingers to an imaginary line passing lengthwise through the middle finger, and the dorsal interossei muscles abduct the fingers from that line. The lumbrical intrinsic muscles, in conjunction with the interossei muscles, flex the proximal phalanges at the metacarpal phalangeal joint, and extend the middle and distal phalanges.

When a hand rehabilitation exercise requires the flexing of the distal and proximal interphalangeal joints, a major problem is that, absent some type of mechanical constraint, the metacarpal phalangeal joint drifts into flexion. If the metacarpal phalangeal joint is flexed, then the intrinsic muscles cannot be properly stretched by flexing the distal and proximal interphalangeal joints. From a physical therapy stance, the optimum position in which to hold the metacarpal phalangeal joint during intrinsic muscle stretching by flexing the distal and proximal interphalangeal joints, is in a 30-45 degree extended position, as depicted in FIG. 8.

Thus, it would be desirable to provide an exercise glove for intrinsic muscles which holds the metacarpal phalangeal joint in some degree of extension, in order to properly stretch the intrinsic muscles by flexing the distal and proximal interphalangeal joints.

The matter is further complicated by the shrinking and atrophy which the hand muscles may have experienced while healing and/or as a result of the injury which the hand has sustained. Thus, while a normal metacarpal phalangeal joint maximum extension may be in the 30-45 degree range, a hand undergoing rehabilitative therapy may only be able to manage 0 degrees flexion initially, which gradually increases over the therapy course.

Therefore, it would be desirable to provide an exercise glove for intrinsic muscles which incorporates means for adjusting a degree of extension imposed on the metacarpal phalangeal joints to accommodate the degree of the extensions of these joints possible for a given individual patient. As each patient progresses, the exercise glove for intrinsic muscles can be adjusted to provide constraint into increasing angles of metacarpal phalangeal joint extension, until as a result of the intrinsic muscle exercises facilitated by the exercise glove for intrinsic muscles, normal metacarpal phalangeal joint maximum extension in the 30-45 degree range is achieved. At this point the intrinsic muscle rehabilitative therapy has been successfully concluded.

In addition, it would be desirable to provide an assist to the flexion of the middle interphalangeal joint, by incorporating elastic members extending from the base of the thenar imminence to each middle finger segment. This assist aids in the stretching of the muscles being exercised.

Existing Designs

A number of designs for hand exercise apparatus have been proposed, but none of these accomplish the instant invention's function of maintaining the metacarpal phalangeal joints at a pre-determined extension angle appropriate for an individual patient, while the patient exercises the intrinsic muscles by flexion of the distal and middle interphalangeal joints.

U.S. Pat. No. 5,976,058 was granted Gustafson for an Apparatus for Effecting Stretching of Intrinsic Muscles and an Associated Method. While this patent taught a method and apparatus to statically provide forces to the hand which caused passive flexion of the proximal and distal interphalangeal joints and extension of the metacarpal phalangeal joints of the fingers, and employed a palmar arch support to resist excessive anterior translation of the flexor digitorum profundus tendon, this reference taught no active flexing movement of the distal and proximal interphalangeal joints, nor resistance to extension of same—only a static splint was disclosed. Thus this design was for a static splint muscle stretching device, not an exercise device.

Pub. No. US 2005/0124464 by Priore disclosed a gauntlet whose semi-rigid plates could be detachably and adjustably positioned relative to each other by means of hook and loop material. While this invention allowed some hand orientations to be constrained, this publication does not constitute priore art for the purposes of this disclosure, because no provision was taught to maintain the metacarpal phalangeal joints in a pre-determined degree of extension, in order to properly stretch the intrinsic muscles by flexing the distal and proximal interphalangeal joints.

U.S. Pat. Nos. 3,944,220, 5,453,064 and 5,456,650 were granted Fasano, Williams Jr., and Williams Jr. et al. for gloves having pockets into which longitudinal resilient stiffening inserts could be inserted. The inserts would apply tension when the fingers and/or hand muscles were flexed, thereby increasing the exercise derived by their use. However, these patents did not teach any provision to maintain the metacarpal phalangeal joints in a pre-determined degree of extension, in order to properly stretch the intrinsic muscles by flexing the distal and proximal interphalangeal joints.

Quite a number of patents have been granted for gloves or gauntlets featuring elastic bands or springs running longitudinally down the fingers and to the wrist. These would provide a force resisting the movement of the fingers, so that the exercise derived from use of these devices would be increased. Some examples of this type of elastic band glove include U.S. Pat. Nos. 5,697,103, 6,450,924 and 5,447,490, granted to Wiggins, Block, and Fula et al. While these provided for increased exercise in some hand muscles, these patents did not teach any provision to maintain the metacarpal phalangeal joints in a pre-determined degree of extension, in order to properly stretch the intrinsic muscles by flexing the distal and proximal interphalangeal joints.

SUMMARY OF THE INVENTION

Accordingly, it is an object of the present invention to provide an exercise glove for intrinsic muscles which holds the metacarpal phalangeal joint in some degree of extension, in order to properly stretch the intrinsic muscle stretching by flexing the distal and proximal interphalangeal joints. Design features allowing this object to be accomplished include at least one rigid rib secured at a rib proximal end to a glove body, and at a rib distal end to a glove finger. Advantages associated with the accomplishment of this object include more effective exercise and stretching of the intrinsic muscles, and consequently a more effective and shorter physical rehabilitation effort.

It is another object of the present invention to provide an exercise glove for intrinsic muscles which incorporates means for adjusting a degree of extension imposed on the metacarpal phalangeal joints to accommodate the degree of the extensions of these joints possible for a given individual patient. Design features allowing this object to be accomplished include at least one plastically deformable rigid rib secured at one end to a glove body, and at another end to a glove finger, and rib tools with which to adjust a rib distal end angle of each rib. Advantages associated with the accomplishment of this object include more effective exercise and stretching of the intrinsic muscles, and consequently a more effective and shorter physical rehabilitation effort.

It is still another object of this invention to provide an exercise glove for intrinsic muscles which provides assist to the flexion of the distal and middle interphalangeal joints, by incorporating elastic members extending from the glove body at the base of the thenar imminence to each patient distal finger segment. This assistance aids in the stretching of the intrinsic muscles. Advantages associated with the realization of this object includes stretching of the muscles being exercised, along with the associated shortened and more effective physical therapy regime.

It is another object of the present invention to provide a method of use an exercise glove for intrinsic muscles which optimally stretches intrinsic muscles. Method steps enabling the accomplishment of this object include bending each rib distal end angle to equal a corresponding patient metacarpal phalangeal joint angle, a patient donning the exercise glove, allowing the exercise glove to passively hold each patient metacarpal phalangeal joint in extension, and actively flexing the patient proximal interphalangeal joints and distal interphalangeal joints. Benefits associated with this method include shorter and more effective physical therapy.

BRIEF DESCRIPTION OF THE DRAWINGS

The invention, together with the other objects, features, aspects and advantages thereof will be more clearly understood from the following in conjunction with the accompanying drawings.

Seven sheets of drawings are provided. Sheet one contains FIG. 1. Sheet two contains FIG. 2. Sheet three contains FIG. 3. Sheet four contains FIGS. 4-6. Sheet five contains FIG. 7. Sheet six contains FIG. 8. Sheet seven contains FIGS. 9 and 10.

DETAILED DESCRIPTION OF THE PREFERRED EMBODIMENT

Figure 1:
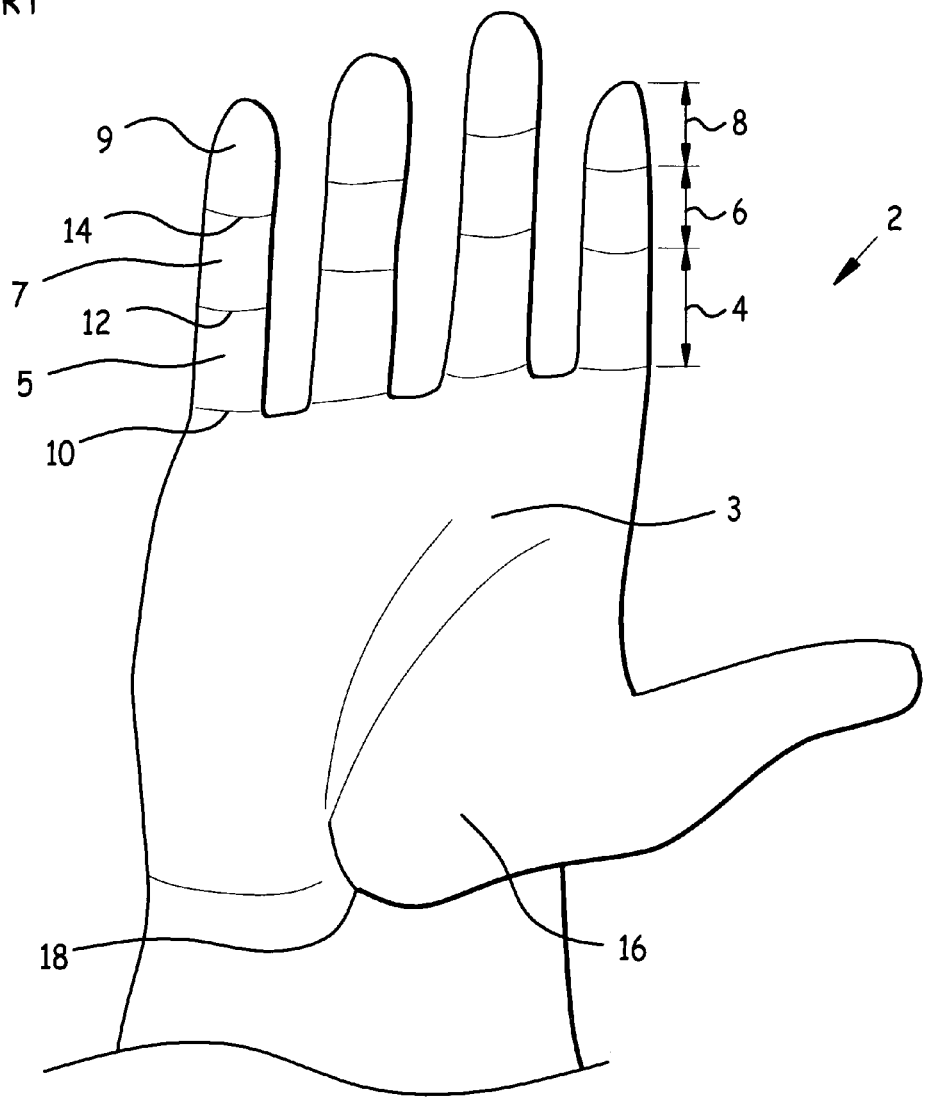
Fig. 1 PRIOR ART
FIG. 1 is a front isometric view of a human hand.
Figure 2:
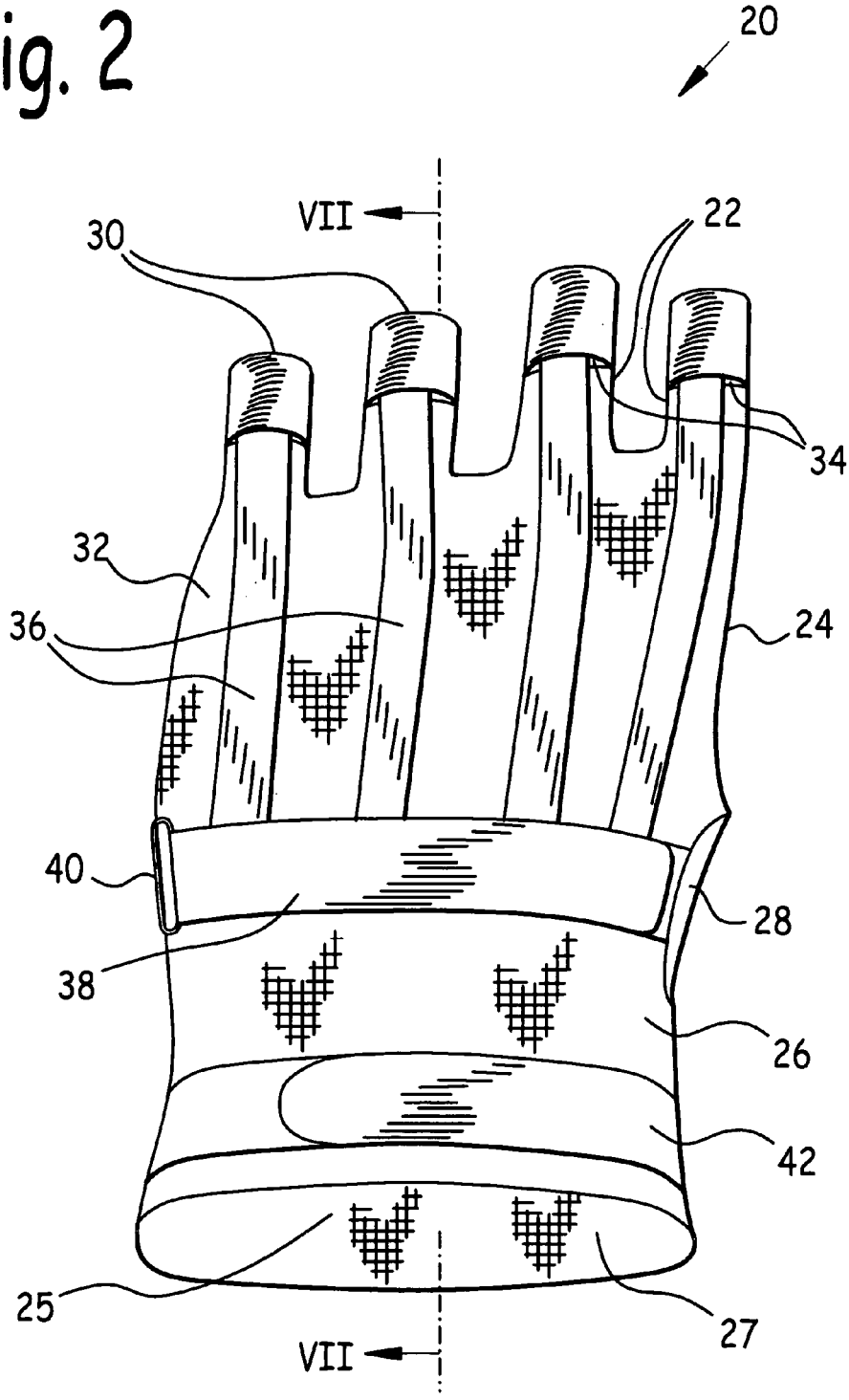
FIG. 2 is a rear isometric view of an exercise glove.

FIG. 2 is a rear isometric view of exercise glove 20. Exercise glove 20 comprises at least one glove finger 22 attached to a distal end of glove body 24, and glove wrist 26 at a proximal end of glove body 24. Each glove finger 22 is sized to encase a proximal finger segment 5 intended to fit into it, and a length of each glove finger 22 may be such that each glove finger 22 extends to but does not encase the proximal interphalangeal joint 12 adjacent such proximal finger segment 5. Although the instant figures depict open-ended glove fingers 22, it is contemplated to be within the scope of this disclosure that exercise glove 20 may incorporate conventional glove fingers 22 which fully encase the wearer's fingers. Whether or not glove fingers 22 are cut off as in the instant figures does not materially affect the function of the instant exercise glove 20. Glove body 24 comprises glove thumb aperture 28 along one side, and glove wrist aperture 27 in glove wrist 26 at its proximal end. Exercise glove 20 may or may not further comprise a glove thumb which would encase the wearer's thumb; the presence or absence of a glove thumb does not materially affect the function of the instant exercise glove 20.

Exercise glove 20 further comprises glove hand void 25 sized to accommodate a human hand 2. Glove hand void 25 communicates with an exterior of exercise glove 20 through one or more glove finger apertures 30, glove thumb aperture 28, and glove hand void 25.

Exercise glove 20 comprises a rib 36 running lengthwise from the wrist area of exercise glove 20 to an end of each glove finger 22 opposite glove wrist 26. In the embodiment depicted in FIGS. 2 and 3, ribs 36 extended from a location on glove back 32 opposite glove thumb aperture 28 to a distal end of glove fingers. In the preferred embodiment, ribs 36 were disposed substantially parallel to glove fingers 22.

Figure 3:
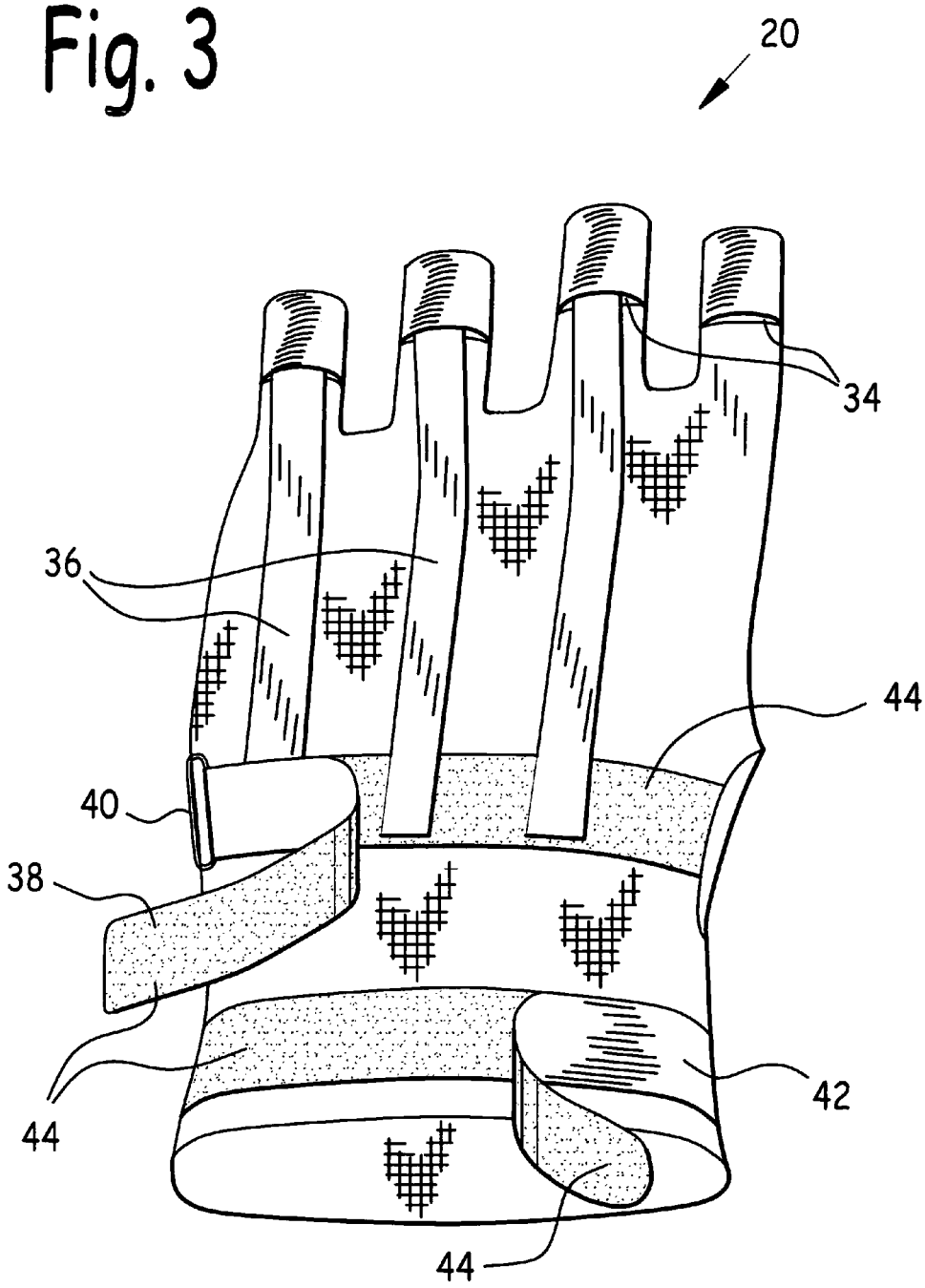
FIG. 3 is a rear isometric view of an exercise glove with one rib removed and the glove back strap loosened.

FIG. 3 is a rear isometric view of an exercise glove with one rib 36 removed and glove back strap 38 loosened. As may be observed in FIG. 3, the proximal end of each rib 36 comprises hook and loop material 44, which may be removably attached to corresponding hook and loop material 44 on glove back 32. Each glove finger 22 comprises a glove finger pocket 34 sized to admit a rib distal end 46. Thus, ribs 36 are held in place on glove back 32 by placing rib distal end 46 into a glove finger pocket 34, and then attaching hook and loop material 44 on rib proximal end 48 to corresponding hook and loop material 44 on glove back 32. The embodiment exercise glove 20 depicted in FIGS. 2 and 3 further comprises glove back strap 38 extending through glove ring 40 and over the hook and loop material 44 on glove back 32. Glove back strap 38 may be laid over distal ends of ribs 36 which are attached to the hook and loop material 44 on glove back 32 and attached to the same hook and loop material 44 to which the distal ends of ribs 36 are attached, in order to strengthen and re-enforce the attachment between the distal ends of ribs 36 and glove back 32.

Figure 4:
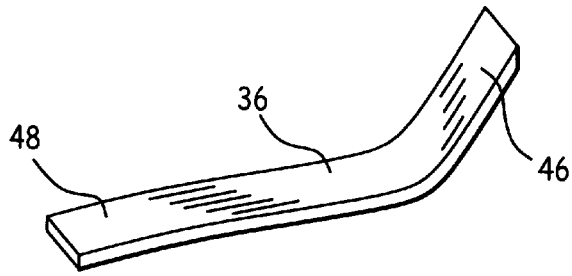
FIG. 4 is an elevated isometric view of a rib.
Figure 5:
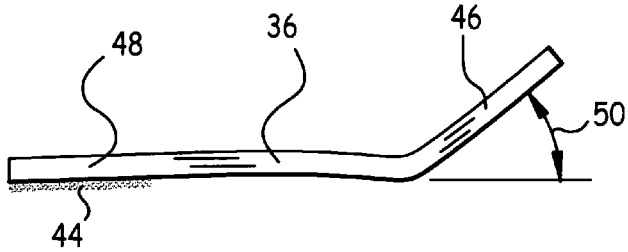
FIG. 5 is a side view of a rib.

FIG. 4 is an elevated isometric view of rib 36. FIG. 5 is a side view of rib 36. As these figures illustrate, rib 36 comprises rib distal end 46, which is intended to be secured to a glove finger 22, and rib proximal end 48, which is intended to be secured to glove back 32. Rib distal end 46 is attached to the rest of rib 36 at rib distal end angle 50. The specific rib distal end angle 50 for a given rib 36 correspondingly determines, the metacarpal phalangeal joint angle 56 at which a proximal phalanx 4 adjacent such rib 36 will be held, as may be more clearly observed in FIGS. 7 and 8.

Figure 6:
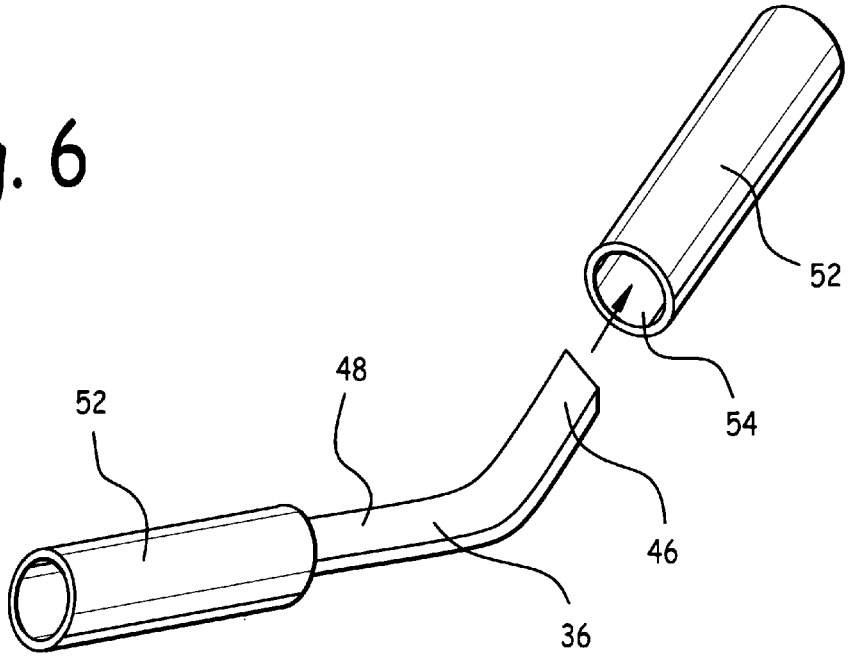
FIG. 6 is an elevated isometric view of a rib whose rib distal end angle is being adjusted by means of a pair of rib tools.

FIG. 6 is an elevated isometric view of a rib 36 whose rib distal angle 50 is being adjusted by means of a pair of rib tools 52. Each rib tool 52 comprises a rib tool aperture 54 sized to admit an end of rib 36. Once both rib distal end 46 and rib proximal end 48 have been inserted into a corresponding rib tool aperture 54, rib tools 52 provide ample leverage to adjust the size of rib distal end angle 50, as desired. Ribs 36 are made of plastically deformable, rigid material such as aluminum, steel, or other appropriate material.

Figure 7:
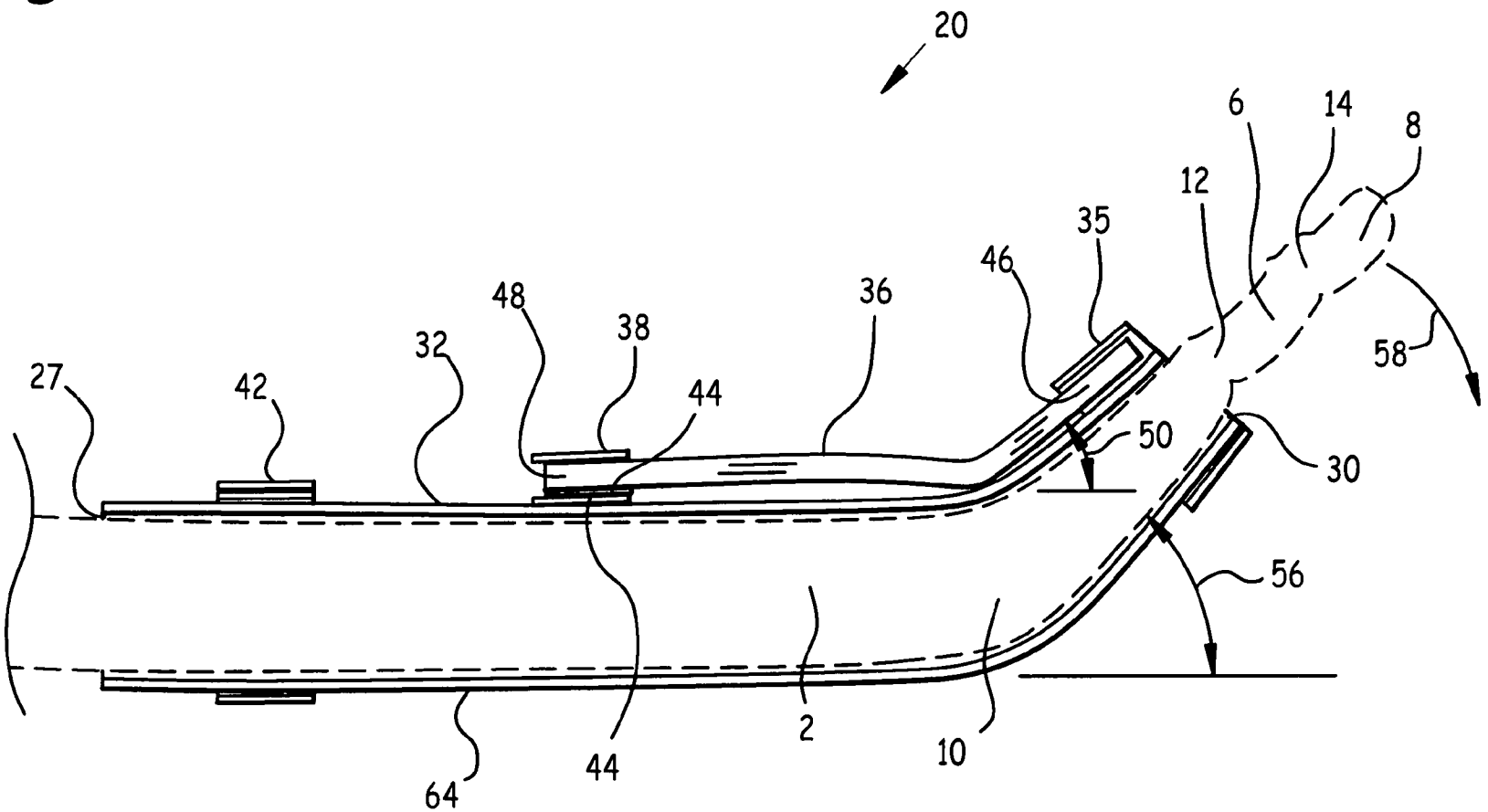
FIG. 7 is a side cross-sectional view of a hand in an exercise glove taken at section VII-VII of FIG. 2 with distal and middle phalanges unflexed.

FIG. 7 is a side cross-sectional view of a hand 2 in an exercise glove 20 taken at section VII-VII of FIG. 2 with distal phalanx 8 and middle phalanx 6 unflexed. Exercise glove 20 is donned in conventional fashion, by inserting a patient's hand through glove wrist aperture 27 into glove hand void 25, thumb through glove thumb aperture 28, and fingers through corresponding glove finger apertures 30.

Each rib 36 has had its rib distal end angle 50 adjusted appropriate to the patient's metacarpal phalangeal joint 10 extension corresponding to the finger each rib 36 will be installed adjacent to, and ribs 36 may be installed on exercise glove 20 before or after donning, as preferred. Each rib 36 is installed on a respective glove finger 22 by inserting rib distal end 46 into glove finger pocket 34, and then attaching hook and the loop material 44 on rib proximal end 48 to the hook and loop material 44 on glove back 32.

After exercise glove 20 is in position on hand 2, glove back strap 38 is attached over rib proximal ends 48 by pulling glove back strap 38 taught through glove ring 40, and then attaching glove back strap 38 over rib proximal ends 48 to the same strip of hook and loop material 44 on glove back 32 to which rib proximal ends 48 are attached, as depicted in FIGS. 2, 3, 7 and 8. Glove wrist strap 42 is secured by pulling taught and attaching its free end to exercise glove 20 using hook and loop material, as depicted in FIG. 3.

Exercise glove 20 may further incorporate glove wrist strap 42 around glove wrist 26. Glove as part of the process of donning exercise glove 20, wrist strap 42 may be pulled tight around glove wrist 26 and secured using hook and loop material 44 or other appropriate fastening means, thus helping to hold exercise glove 20 securely on hand 2.

Although the instant figures disclose the use of hook and loop material 44 as means to attach rib proximal end 48 to glove back 32, it is intended to fall within the scope of this disclosure that any appropriate means be employed to attach rib proximal end 48 to glove back 32, including but not limited to snaps, pockets similar to glove finger pockets 34 disposed on glove back 32, or any other appropriate means of attaching rib proximal end 48 to glove back 32. Similarly, although the instant figures show glove finger pockets 34 as means of attaching rib distal end 46 to glove finger 22, it is intended to fall within the scope of this disclosure that any appropriate means be employed to attach rib distal end 46 to glove finger 22, including but not limited to snaps, hook and loop material, or any other appropriate means, of attaching rib distal end 46 to glove finger 22. In addition, although the instant figures show hook and loop material 44 as means of securing glove back strap 38 and glove wrist strap 42, it is intended to fall within the scope of this disclosure that any appropriate means be employed for these purposes, including but not limited to snaps, buttons, strap buckles, or any other appropriate means of securing glove back strap 38 and glove wrist strap 42.

Once exercise glove 20 is secured in place on a patient's hand 2, with each rib 36 having had its rib distal end angle 50 adjusted to equal the maximum metacarpal phalangeal joint angle 56 available for its corresponding finger, exercise in accordance with the instant method may commence. One principal object of the instant apparatus and method is to passively hold metacarpal phalangeal joints 10 in extension (as urged by rib distal end angles 50) while actively flexing proximal interphalangeal joints 12 and distal interphalangeal joints 14, in order to obtain optimal intrinsic muscle stretch. This object is accomplished by adjusting rib 36 to have the correct rib distal end angles 50 to be equal to corresponding metacarpal phalangeal joint angles 56 as described above, donning and securing exercise glove 20, and then actively flexing proximal interphalangeal joints 12 and distal interphalangeal joints 14 as indicated by arrow 58 in FIG. 7 and arrow 62 in FIG. 8.

Figure 8:
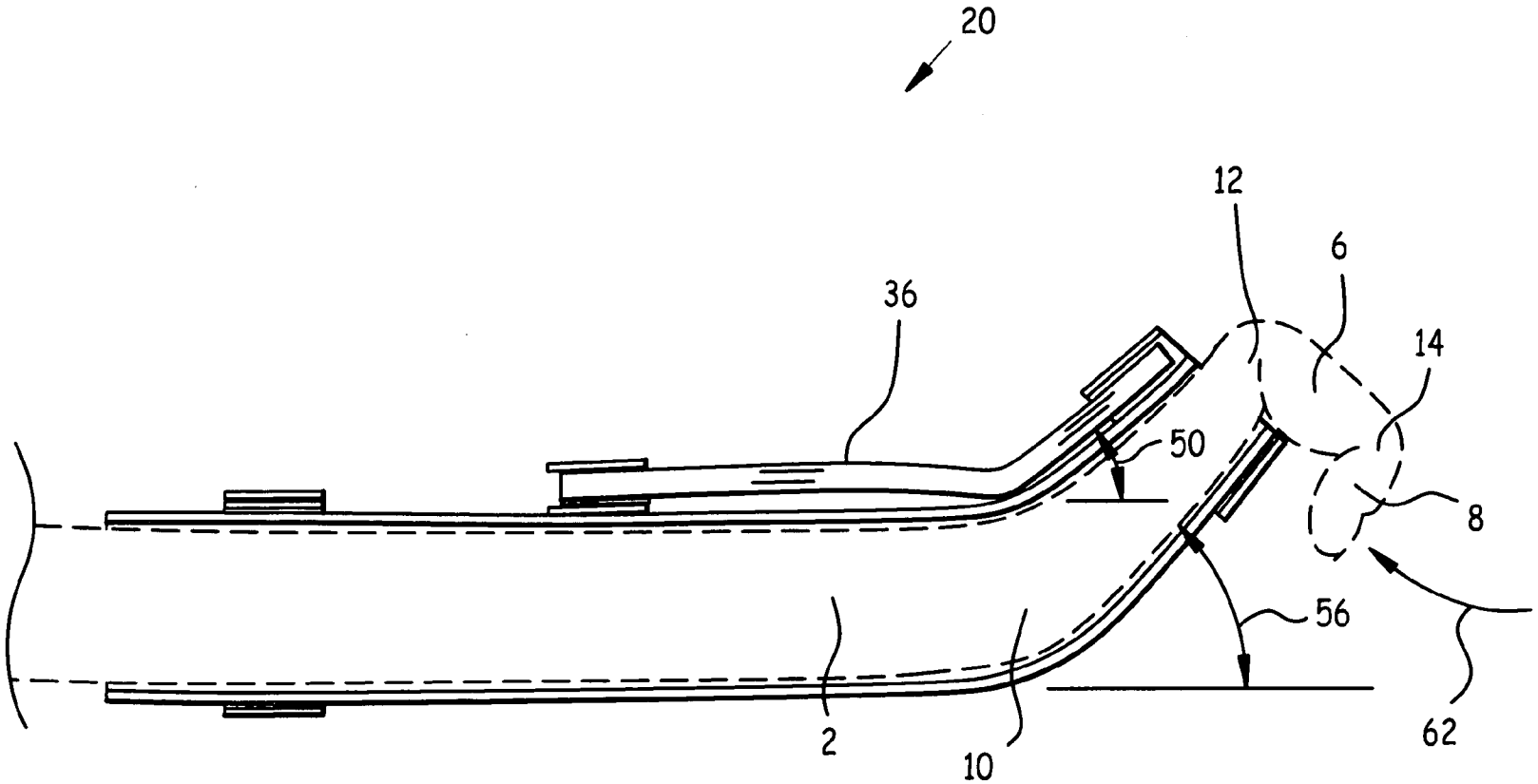
FIG. 8 is a side cross-sectional view of a hand in an exercise glove taken at section VII-VII of FIG. 2 with distal and middle phalanges flexed at the distal interphalangeal joint and proximal interphalangeal joint, respectively.

FIG. 8 is a side cross-sectional view of hand 2 in an exercise glove 20 taken at section VII-VII of FIG. 2, with proximal interphalangeal joints 12 and distal interphalangeal joints 14 flexed, as indicated by arrow 62. After the patient actively flexes proximal interphalangeal joints 12 and distal interphalangeal joints 14 into the position depicted in FIG. 8, the patient actively unflexes these joints into the position depicted in FIG. 7, by moving them opposite the sense of arrow 58 in FIG. 7 and arrow 62 in FIG. 8.

Over time, use of the instant exercise glove 20 in combination with the active exercise described in the preceding paragraphs will stretch the patient's intrinsic muscles, permitting rib distal end angles 50 to be increased. Thus, at the beginning of each exercise session, or as otherwise appropriate, the physical therapist will note the maximum metacarpal phalangeal joint angle 56 available in each finger, and set the corresponding rib distal end angle 50 to that size, as described above and illustrated in FIG. 6.

In this way, rib distal end angles 50 progressively increase over the course of the therapy. When rib distal end angles 50 have increased to normal range (30-45 degrees), the therapy has successfully stretched the intrinsic muscles back to normal, and the therapy relating to the stretching of the intrinsic muscles may be concluded.

Exercise glove 20 may incorporate glove finger pocket straps 35 encircling the open ends of glove fingers 22 and glove finger pockets 34, as depicted in FIGS. 7 and 8. Glove finger pocket straps 35 serve to re-enforce glove finger pockets 34, and may be permanently attached around open ends of glove fingers 22 and glove finger pockets 34.

In the preferred embodiment, glove finger pocket straps 35, glove back strap 38, and glove wrist strap 42 were made of non-stretching material, so as to closely constrain the position of hand 2 to the conform to shape of ribs 36, and especially to constrain the metacarpal phalangeal joint angle 56 of each patient finger to mirror the rib distal end angle 50 in the rib 36 corresponding to such 22 patient finger. It is intended to fall within the scope of this disclosure that glove back strap 38 may extend completely around hand 2, in order to help ensure close proximity between patient hand 2 and rib proximal ends 48.

Although in the instant figures ribs 36 are taught to be removably attached to exercise glove 20, and their rib distal end angles 50 adjustable using rib tools 52, it is contemplated to fall within the scope of this disclosure that ribs 36 may be permanently attached to exercise glove 20, and their respective rib distal end angles 50 may be adjusted by hand, or using a pair of pliers, or using any other appropriate means of adjusting rib distal end angles 50. In addition, although ribs 36 are illustrated herein to be attached to glove back 32, it is intended to fall within the scope of this disclosure that ribs 36 may alternately be attached to glove front 64, by the same means (glove finger pockets 34, hook and loop material 44, etc.) as ribs 36 may be attached to glove back 32. In the preferred embodiment, ribs 36 extend substantially from a corresponding glove finger 22 to a location on exercise glove 20 opposite a patient thumb pertaining to a patient hand 2 disposed within exercise glove 20, and ribs 36 were substantially parallel to glove fingers 22.

In the embodiment thus far described and illustrated, ribs 36 were made of plastically deformable, rigid material, and bent to shape to match their rib distal end angles 50 with metacarpal phalangeal joint angles 56 of individual patients. An alternate rib 36 embodiment is hereby disclosed wherein ribs 36 are made of rigid material, and an assortment of rib 36 having a range of rib distal end angles 50 is provided with exercise glove 20. In the case of this alternate embodiment, the physical therapist chooses a rib 36 which has the correct rib distal end angle 50 appropriate for a given metacarpal phalangeal joint angles 56, and attaches such rib to glove body 24 and an appropriate glove finger 22. This alternate embodiment dispenses with the step of bending each rib distal end angle 50 to correspond to a patient metacarpal phalangeal joint angle 56, and instead substitutes the step of choosing a rib 36 with appropriate rib distal end angle 50 from an array of ribs 36 provided.

Figure 9:
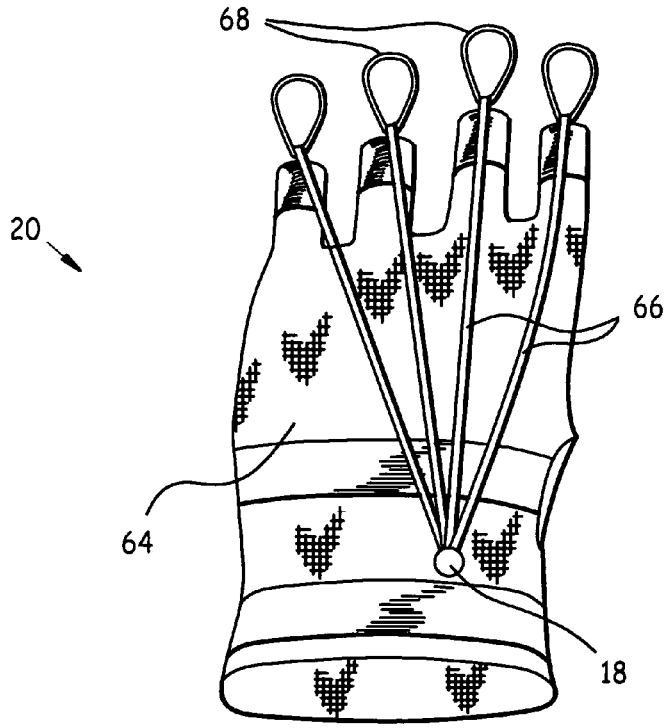
FIG. 9 is a front view of an exercise glove incorporating elastic members.

FIG. 9 is a front view of an exercise glove 20 incorporating elastic members 66. Each elastic member 66 is attached at one end to thenar imminence base 18, and terminates at the opposite end in elastic member loop 68. Elastic member loop 68 is sized to admit a patient middle finger segment 9.

Figure 10:
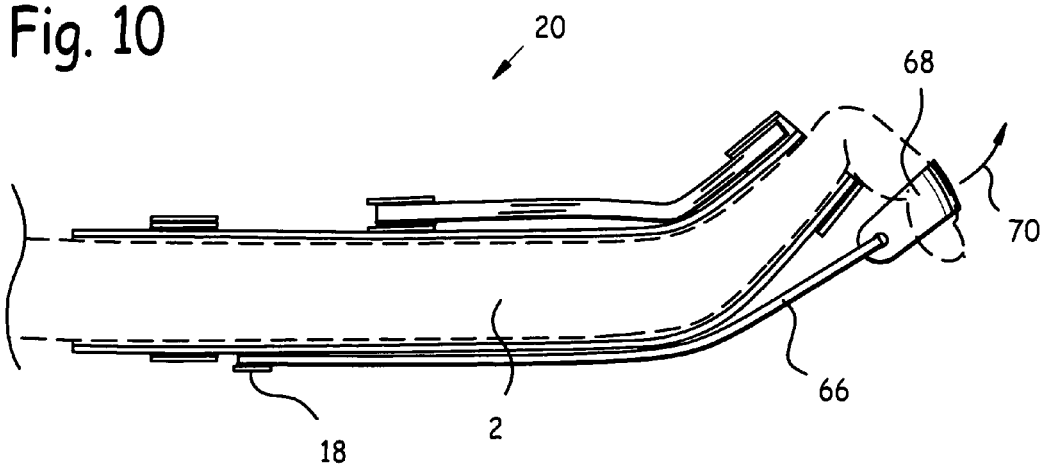
FIG. 10 is a side cross-sectional view of a hand in an exercise glove, with the assist of the pull of the elastic members.

Elastic members 66 are intended to provide assistance to the flexing of proximal interphalangeal joints 12, as indicated by arrow 70 in FIG. 10. FIG. 10 is a side cross-sectional view of hand 2 in exercise glove 20, displaying the assistance flexion stretching force of elastic members 66.

In the preferred embodiment, glove body was made of fabric, nylon, fabric, leather, or other appropriate material. Glove wrist strap 42, glove back strap 38, glove finger pockets 34 and glove finger pocket straps 35 were made of nylon strap, leather, other synthetic strap, or other appropriate material. Ribs 36 were made of aluminum, steel, iron, or other appropriate plastically deformable, rigid material. In the alternative, ribs 36 could be made of any appropriate rigid material, including but not limited to metal, nylon, other appropriate synthetic, plastic, wood, etc. Hook and loop material 44 and glove ring 40 were commercially available, off-the-shelf materials.

While a preferred embodiment of the invention has been illustrated herein, it is to be understood that changes and variations may be made by those skilled in the art without departing from the spirit of the appending claims.

DRAWING ITEM INDEX

| | |
|---|---|
| 2 | hand |
| 3 | metacarpus |
| 4 | proximal phalanx |
| 5 | proximal finger segment |
| 6 | middle phalanx |
| 7 | middle finger segment |
| 8 | distal phalanx |
| 9 | distal finger segment |
| 10 | metacarpal phalangeal joint |
| 12 | proximal interphalangeal joint |
| 14 | distal interphalangeal joint |
| 16 | thenar imminence |
| 18 | thenar imminence base |
| 20 | exercise glove |
| 22 | glove finger |
| 24 | glove body |
| 25 | glove hand void |
| 26 | glove wrist |
| 27 | glove wrist aperture |
| 28 | glove thumb aperture |
| 30 | glove finger aperture |
| 32 | glove back |
| 34 | glove finger pocket |
| 35 | glove finger pocket strap |
| 36 | rib |
| 38 | glove back strap |
| 40 | glove ring |
| 42 | glove wrist strap |
| 44 | hook and loop material |
| 46 | rib distal end |
| 48 | rib proximal end |
| 50 | rib distal end angle |
| 52 | rib tool |
| 54 | rib tool aperture |
| 56 | metacarpal phalangeal joint angle |
| 58 | arrow |
| 62 | arrow |
| 64 | glove front |
| 66 | elastic member |
| 68 | elastic member loop |
| 70 | arrow |

I claim:

1. An exercise glove for intrinsic muscles comprising a glove body encasing a hand void, at least one glove finger at one end of said glove body, each said at least one glove finger being attached at one end to said glove body, a glove thumb aperture in said glove body, an adjustable plastically deformable rigid rib associated with each said glove finger comprising a rib distal end and a rib proximal end, whereby said rib maintains it shape after being plastically deformed, means of attaching each said rib distal end to a respective said glove finger, and means of attaching each said rib proximal end to said glove body, whereby said rib may hold only a respective metacarpal phalangeal joint within said glove at a maximum available angle of extension, and wherein a proximal interphalangeal joint and a distal interphalangeal joint remain free to be exercised.

2. The exercise glove for intrinsic muscles of claim 1 wherein each said rib further comprises a rib distal end angle measuring between 0 and 45 degrees, whereby a physical therapist may set said rib distal end angle to equal a metacarpal phalangeal joint angle in a patient using the plastically deformable rigid material of said rib.

3. The exercise glove for intrinsic muscles of claim 2 wherein said means of attaching each said rib distal end to a respective glove finger comprises a glove finger pocket attached to each said glove finger, each said rib distal end being sized to fit into a corresponding said glove finger pocket.

4. The exercise glove for intrinsic muscles of claim 2 wherein said means of attaching each said rib proximal end to said glove body comprises hook and loop material on said rib proximal end mating with hook and loop material on said glove body.

5. The exercise glove for intrinsic muscles of claim 4 wherein said glove further comprises a glove wrist attached to an end of said glove body opposite said at least one glove finger, and a glove wrist strap around said glove wrist, whereby said exercise glove may be more securely attached to a patient hand.

6. The exercise glove for intrinsic muscles of claim 4 wherein said glove further comprises a glove back strap covering each said rib proximal end, said glove back strap being attached to said glove body by means of hook and loop material on said glove back strap mating with the same strip of hook and loop material to which each said rib proximal end is attached, whereby said glove body may be held in close proximity to a patient hand.

7. The exercise glove for intrinsic muscles of claim 6 further comprising a glove ring attached to said glove body, said glove back strap passing through said glove ring prior to being attached to said glove body.

8. The exercise glove for intrinsic muscles of claim 2 further comprising at least one rib tool, each said rib tool comprising a rib tool aperture sized to admit said rib distal end or said rib proximal end, whereby leverage may be brought to bear on said rib to adjust said rib distal end angle.

9. The exercise glove for intrinsic muscles of claim 3 further comprising a glove finger pocket strap encircling each said glove finger and corresponding said glove finger pocket, whereby an attachment of said rib distal end to a corresponding said glove finger may be re-enforced.

10. The exercise glove for intrinsic muscles of claim 2 further comprising an elastic member corresponding to each said glove finger, a glove back on one side of said glove body, and a glove front on an opposite side of said glove body, each said rib being attached to said glove back, each said elastic member being attached at one end to a location on said glove front corresponding to a thenar imminence base in a patient hand inside said exercise glove, and an elastic member loop attached to an end of each said elastic member opposite said thenar imminence base, each said elastic member loop being sized to admit a middle finger segment of a patient finger.

11. A method of use for an exercise glove for intrinsic muscles, said exercise glove comprising a glove body encasing a hand void, glove fingers at one end of said glove body, a glove thumb aperture in said glove body, a plastically deformable rigid rib associated with each said glove finger comprising a rib distal end disposed at a rib distal end angle relative to a rib proximal end, whereby said rib maintains it shape after being plastically deformed, means of attaching each said rib distal end to a respective glove finger, and means of attaching each said rib proximal end to said glove body, said method of use comprising the steps of:

A. Bending each said rib distal end angle to substantially equal a corresponding patient metacarpal phalangeal joint angle;

B. Donning said exercise glove by a patient by inserting a patient hand into said hand void, a patient finger into each said glove finger, and a patient thumb through said glove thumb aperture;

C. Allowing said exercise glove to rigidly hold only each said patient metacarpal phalangeal joint in extension; and D. Actively flexing patient proximal interphalangeal joints and distal interphalangeal joints, whereby patient intrinsic muscles may be stretched.

12. The method of claim 11 comprising the further step of extending said patient proximal interphalangeal joints and distal interphalangeal joints following their flexion in step D.

13. The method of claim 11 comprising the further steps of removing each said rib from said exercise glove prior to setting its rib distal end angle, and then re-attaching each said rib distal end to a respective glove finger and each said rib proximal end to said glove body.

14. The method of claim 11 wherein said means of attaching each said rib distal end to a respective glove finger comprises a glove finger pocket attached to each said glove finger, each said rib distal end being sized to fit into a corresponding said glove finger pocket, and said method of use comprises the further step of attaching said rib distal end to said glove finger by inserting said rib distal end into a corresponding said glove finger pocket.

15. The method of claim 11 wherein said means of attaching each said rib proximal end to said glove body comprises hook and loop material on said rib proximal end mating with hook and loop material on said glove body, and said method of use comprises the further step of attaching said rib proximal end to said glove body by mating said hook and loop material on said rib proximal end with said hook and loop material on said glove body.

16. The method of claim 12 comprising the further step of measuring a maximum patient metacarpal phalangeal joint angle prior to each exercise session, setting a corresponding rib distal end angle to substantially equal said maximum patient metacarpal phalangeal joint angle, and concluding said exercise sessions when said maximum patient metacarpal phalangeal joint angle ascends to a normal or desired value.

17. The method of claim 12 wherein said exercise glove further comprises an elastic member corresponding to each said glove finger, each said elastic member being attached at one end to a location on said glove body corresponding to a thenar imminence base in a patient hand inside said exercise glove, and an elastic member loop attached to an end of each said elastic member opposite said thenar imminence base, each said elastic member loop being sized to admit a patient middle finger segment, and said method comprises the further step of inserting a middle finger segment of a patient finger into a corresponding said elastic member loop prior to passively flexing said patient proximal interphalangeal joints, whereby a stretching value to said patient intrinsic muscles may be increased.

18. The method of claim 13 comprising the further step of setting each rib distal end angle using a pair of rib tools, each said rib tool comprising a rib tool aperture sized to admit said rib distal end or said rib proximal end, inserting a rib proximal end in one said rib tool aperture and inserting a rib distal end in another said rib tool aperture, and using said rib tools to set a rib distal angle.

19. A method of use for an exercise glove for intrinsic muscles, said exercise glove comprising a glove body encasing a hand void, glove fingers at one end of said glove body, a glove thumb aperture in said glove body, a plurality of rigid ribs, each said rib comprising a rib distal end disposed at a rib distal end angle relative to a rib proximal end, means of attaching each said rib distal end to a respective glove finger, and means of attaching each said rib proximal end to said glove body, said method of use comprising the steps of:

A. Selecting, from a plurality of said ribs, one said rib having a rib distal end angle substantially equal to a corresponding patient metacarpal phalangeal joint angle;

B. Attaching the selected rib to said exercise glove adjacent a patient finger associated with said corresponding patient metacarpal phalangeal joint angle;

C. Donning said exercise glove by a patient by inserting a patient hand into said hand void, a patient finger into each said glove finger, and a patient thumb through said glove thumb aperture;

D. Allowing said exercise glove to rigidly hold only each said patient metacarpal phalangeal joint in extension; and E. Actively flexing patient proximal interphalangeal joints and distal interphalangeal joints, whereby patient intrinsic muscles may be stretched.

20. An exercise glove for intrinsic muscles comprising a glove body with at least one glove finger, each said glove finger being sized to encase a patient proximal finger segment, a rigid rib comprising a rib distal end and a rib proximal end, each said rib distal end being attached to a corresponding glove finger, and each said rib being attached to said glove body each said rib comprising a rib distal end angle between said rib distal end and said rib proximal end, each said rib distal end angle being set to equal a corresponding patient metacarpal phalangeal joint angle, whereby patient metacarpal phalangeal joints are rigidly held in extension while the patient may actively flex proximal interphalangeal joints and distal interphalangeal joints, in order to obtain optimal stretch of said intrinsic muscles.

21. The exercise glove for intrinsic muscles of claim 20 wherein each said rib extends substantially from a corresponding said glove finger to a location on said glove opposite a patient thumb pertaining to a patient hand disposed within said exercise glove, and wherein each said rib is substantially parallel to said at least one glove finger.

* * * * *